US006272793B1

(12) United States Patent
Davlantes

(10) Patent No.: US 6,272,793 B1
(45) Date of Patent: Aug. 14, 2001

(54) HEIGHT ADJUSTABLE ASSEMBLY FOR PET DOOR

(76) Inventor: George N. Davlantes, 21457 Iglesia Dr., Woodland Hills, CA (US) 91364

( * ) Notice: Subject to any disclaimer, the term of this patent is extended or adjusted under 35 U.S.C. 154(b) by 0 days.

(21) Appl. No.: 09/477,194

(22) Filed: Jan. 4, 2000

(51) Int. Cl.[7] ..... E05D 15/48
(52) U.S. Cl. ..... 49/168; 49/169; 49/501
(58) Field of Search ..... 49/167, 168, 169, 49/501, 309, 310, 311, 312, 505

(56) References Cited

U.S. PATENT DOCUMENTS

| | | | | |
|---|---|---|---|---|
| 3,878,645 | * | 4/1975 | Porter | 49/169 |
| 4,020,595 | * | 5/1977 | Duncan | 49/306 |
| 4,047,331 | * | 9/1977 | Davlantes | 49/171 |
| 4,262,450 | * | 4/1981 | Anderson | 49/425 |
| 4,671,016 | * | 6/1987 | Boeckx | 49/501 |
| 4,850,144 | * | 7/1989 | Grisham et al. | 49/482 |
| 4,922,659 | * | 5/1990 | Muccioli | 49/501 |
| 5,119,593 | * | 6/1992 | Bae | 49/501 |
| 5,551,188 | * | 9/1996 | Davlantes | 49/169 |
| 5,921,026 | * | 7/1999 | Miller | 49/27 |
| 6,125,584 | * | 10/2000 | Sanders | 49/312 |

* cited by examiner

*Primary Examiner*—Daniel P. Stodola
*Assistant Examiner*—Curtis A. Cohen
(74) *Attorney, Agent, or Firm*—Lahive & Cockfield, LLP

(57) ABSTRACT

A height adjuster for a pet door panel to be fitted in a sliding door frame has nesting, or telescoping, spacers atop the pet door panel frame, capped with a top piece engageable with the sliding door frame. In one embodiment, a screw seats in the top piece and passes thought the spacers, the number of which can be selected to adjust the height, and engages a nut in the pet door panel to secure the height adjuster together. In another embodiment, a piston-like top piece is biased away from the pet door panel, and the pet door panel frame includes moveable biased wedges, which positions the top piece relative to the pet door panel frame.

3 Claims, 3 Drawing Sheets

HEIGHT ADJUSTABLE ASSEMBLY FOR PET DOOR

FIELD OF THE INVENTION

The invention relates to pet door panels insertable into sliding door frames and particularly to assemblies for adjusting the height of the pet door panel to fit varying sliding door frame sizes.

BACKGROUND OF THE INVENTION

Pet access doors provide an opening, usually equipped with a swinging flap, through which pets can leave or enter a home or other building. The pet access doors may be set in a frame to be inserted in a hole in a wall or door. They also may be used at one side of the framed opening for sliding glass doors, such as those giving egress to patios and porches. Those doors are usually of glass and framed in aluminum. In such cases, the pet doors are usually part of a long panel, also of aluminum and glass, to extend the entire height of one side of the sliding door frame. Since sliding doors vary somewhat in height, a problem in the field is how to vary the height of the pet door panel so that it will fit different height sliding door frames.

One approach is to provide a telescoping top frame member, illustrated in the inventors earlier U.S. Pat. No. 4,047,331 and U.S. Pat. No. 4,408,416. These do require some cutting to size of other panel members, which is inconvenient and which can be problematical if a wrong measurement is made.

The purpose of the invention, therefore, is to provide an easy-to-use height adjustment assembly for pet door panels for sliding door frames.

SUMMARY OF THE INVENTION

The invention provides a height adjustable spacer apparatus for adjusting the height of a pet door panel frame to be fitted within a sliding door frame. The apparatus includes a pet door panel frame with a horizontal top frame member, a series of spacers (at least one) having downwardly projecting means for nesting engagement with each other and the horizontal top frame member, and a sliding door frame engaging member, also having downwardly projecting means for nesting in a spacer. Preferably, the elements all have perimeters that are aligned.

In one embodiment, the apparatus includes a nut secured to the top frame member, a screw seating portion in the sliding door engaging member, and a screw passable through the seating portion to engage the nut, the spacers in between having aligned openings so that the screw secures the apparatus together.

In another embodiment, the sliding door frame engaging member is movably biased away from a spacer in which it is a nesting relationship, and the horizontal top frame member includes moveable wedge means for engaging a spacer to adjust the distance between the spacer and member. The wedge means may include biaising means to bias the wedge means to maximize the distance of the spacer from the horizontal top frame member.

BRIEF DESCRIPTION OF THE INVENTION

Other aspects, features and variations of the invention will be described below, or will be apparent from the following description of preferred embodiments of the invention, including the drawings thereof, in which.

Figure 1:
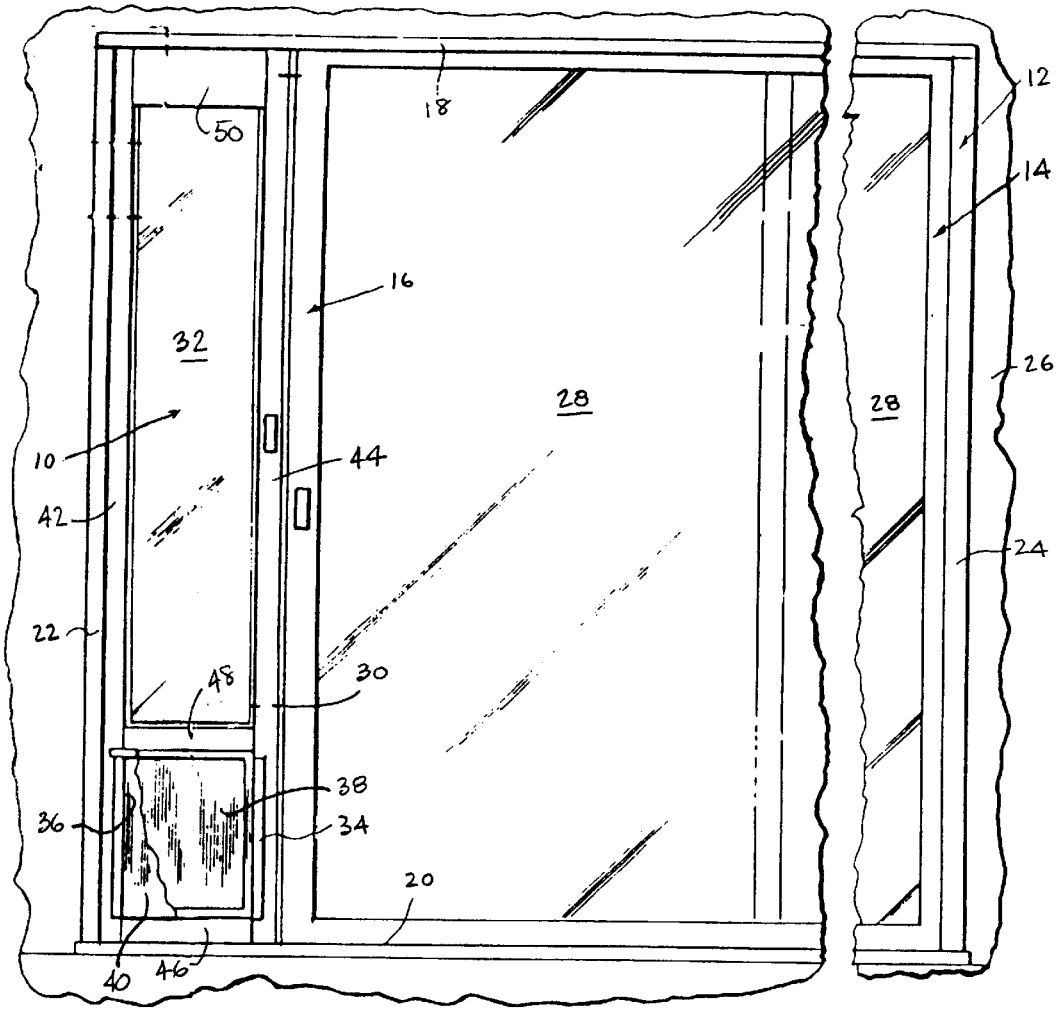
FIG. 1 is an elevational view, partially broken away, of the pet door panel of the invention in place in a sliding door frame.

In FIG. 1, a pet door panel 10 is shown installed in a sliding door frame 12 having an outer sliding door 14 and an inner sliding door 16. The pet door panel 10 abuts the inner sliding door 16. The sliding door frame 12 has an upper frame rail 18 and a sill 20, and stiles 22 and 24, set in the wall 26 of the structure. Each sliding door 14, 16 has a conventional weather pane 28 of glass.

The pet door panel 10 consists of a frame 30, typically aluminum, a weather pane 32, of glass, and a pet door unit 34. The pet door unit 34 has a pet doorway 36 closed by a swinging flap 38, and typically includes a security cover 40, which is installed on the inside of the pet doorway 36 when the doorway is not in use.

The pet door panel frame 30 has vertical frame members, or stiles 42, 44. The frame 30 also includes a horizontal bottom frame member 46 seated in the track of the sliding door sill 20, an intermediate horizontal frame member 48, and a horizontal top frame adjustable apparatus, or assembly 50, to be described in detail below. The horizontal top frame adjustable assembly 50 is seated in the upper track of the upper frame rail 18 of the sliding door frame 12.

The pet door panel frame 30 is secured to the side of the sliding door frame 12 by conventional means, such as those described in the patents referred to above, and not shown here. The pet door frame 30 furthermore includes means, also not shown here, but well known to those skilled in the art, for latching sliding door 16 to the frame 30.

Figure 2:
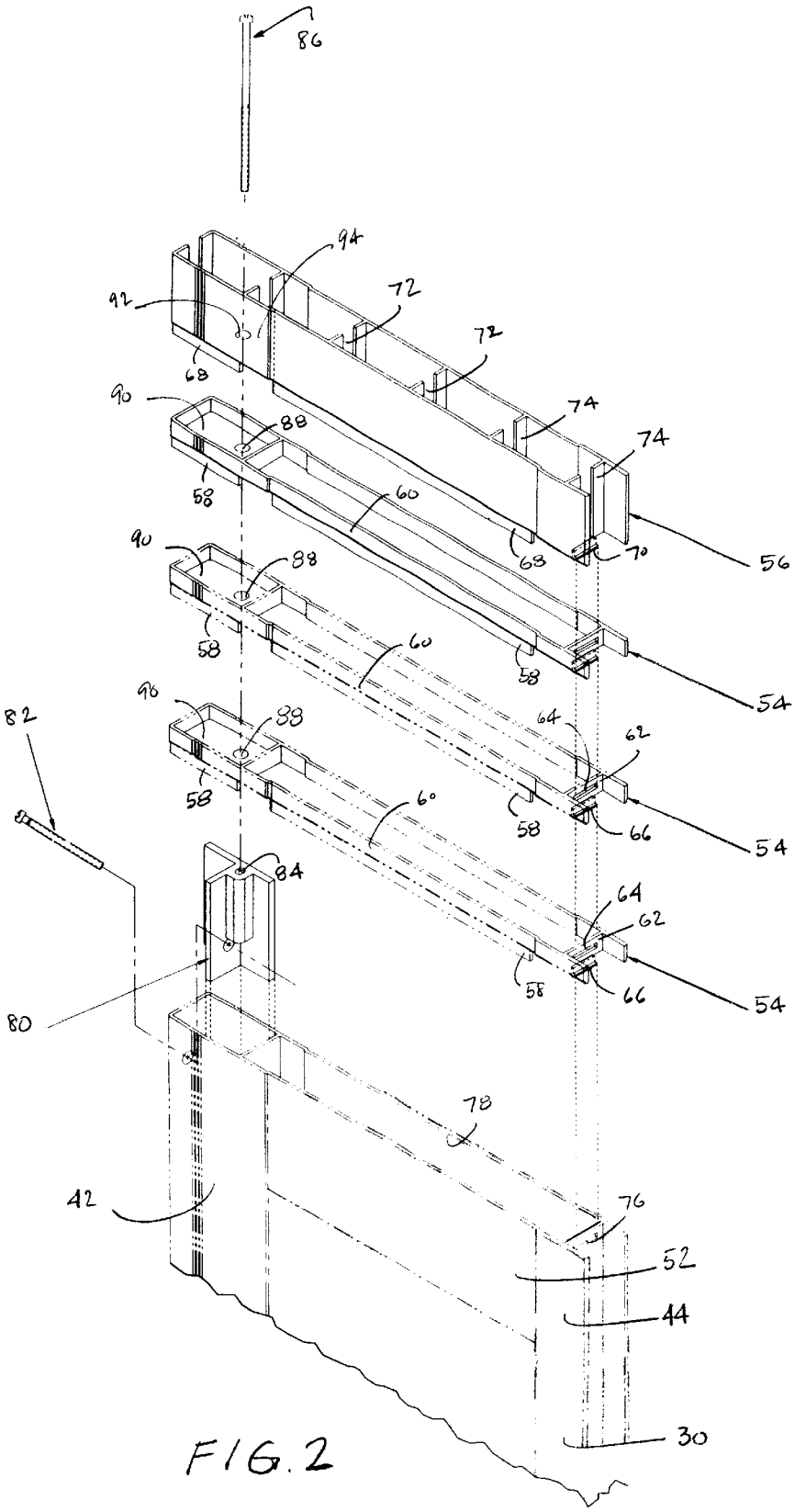
FIG. 2 is an exploded perspective view of a first embodiment of a height adjustable assembly for the pet door panel of FIG. 1.

A first embodiment of the construction of the adjustable horizontal top frame assembly 50 of the pet door panel frame 30 is shown in FIG. 2. The apparatus, or assembly, 50 includes a horizontal top frame member 52, a series of spacers 54, and a sliding door frame engaging member, or topmost member 56. The topmost member 56 and the spacers 54 have perimeters substantially aligned with the top frame member 52, so that a smooth vertical planar surface is presented when the unit is assembled.

In the assembled unit, the number of spacers 54 determines the height of the assembly 50 and, therefor, the height of the pet door panel frame 30. The height of the spacers 54 is chosen so that it is less than the height of the track of the upper frame rail 18 of the sliding door frame 12. A spacer height that appears to be adequate is ¼ inch. With twelve such spacers 54 (only three are shown in FIG. 2), a three inch variation in height of the pet door frame 30 is achieved, and that appears to be adequate for most sliding door frames 12.

When the unit is assembled, each spacer 54 nests in the spacer below. Each spacer 54 has a lower projecting wall 58 that nests within the upper wall 60 of the spacer 54 below. Furthermore, each spacer 54 has a side wall 62 with a slot 64 and a downwardly projecting tab 66 to engage the slot 64 of the spacer 54 below. The topmost member 56 has a lower projecting wall 68 to nest in the spacer 54 below it, and has a side wall with a lower projecting tab 70 to engage the slot 64 of the spacer 54 below. The topmost member 56 has a slot 72 formed in its internal framing 74 to accommodate a center guide that many sliding door frames 12 have in the upper frame rail 18. The horizontal top frame member 52 has a slot 76 to accommodate the tab 66 of a spacer 54 above, and has an upper wall 78 to accommodate, in a nesting relationship, the lower projecting wall 58 of the spacer 54 above.

The unit includes an insert 80 that is installed in the hollow frame of stile 42 and secured there by a screw 82. The insert 80 has a threaded vertical hole or nut, 84 to accommodate an assembly screw 86. Each spacer 54 has a hole 88 in the horizontal wall 90 of the spacer to accommodate assembly screw 86. The topmost member 56 has a screw seating hole 92 in its horizontal wall 94.

In use, the pet door panel 10 will have all the spacers 54 and the topmost member 56 installed at the factory and secured to the top frame member 52 by the tabs 66, 70 and slots 64, 76 on one side, and the assembly screw 86 on the other. The customer who buys the pet door panel 10 measures the height of the sliding glass door opening, removes the assembly screw 86, and removes as many spacers 54 as required. Then, making sure that each spacer 54 is installed by inserting its tab 66 into a slot below, and that the topmost member 56 is at the top, the customer reinserts the assembly screw 86 and tightens it.

Figure 3:
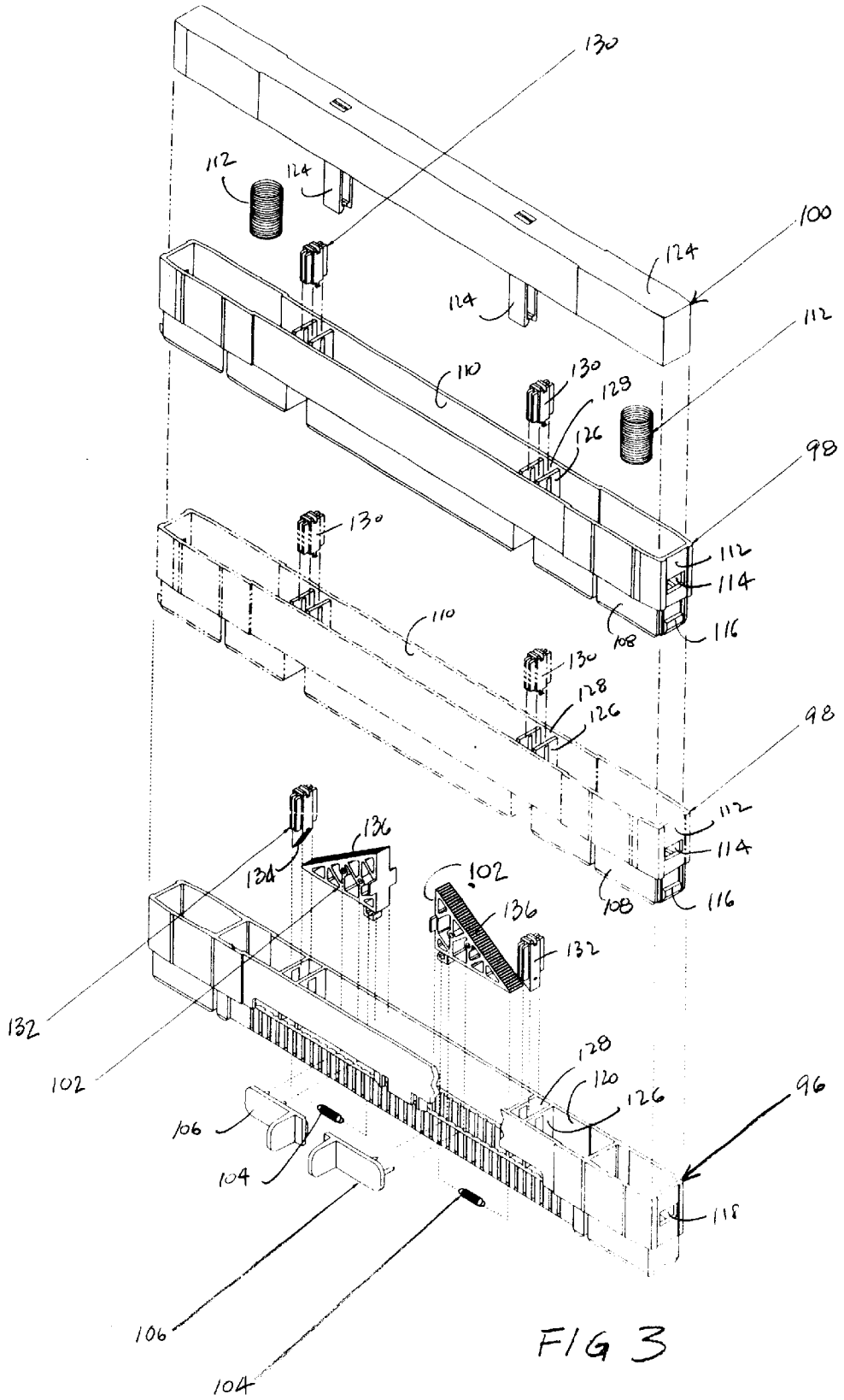
FIG. 3 is an exploded perspective view of a second embodiment of a height adjustable assembly for the pet door panel of FIG. 1.

A second embodiment is shown in FIG. 3. In this embodiment, the top frame member 96 is secured to the top of the pet door panel frame 50, there are a series of nestable spacers 98, and a sliding door frame engagement member, or topmost member 100. The topmost member 100 and the spacers 98 have perimeters substantially aligned with the top frame member 96, so that a smooth vertical planar surface is presented when the unit is assembled.

The top frame member, or base housing, 96 is secured to the top of the pet door frame panel frame 50 at the factory and is not removed from it. The base housing 96 contains a pair of wedges 102 that slide horizontally, biased by expansion springs 104 to slide outwardly toward the outer edge of the base housing 96. Latches 106 are attached to each wedge 102 to permit moving the wedges 102 inwardly against the bias of the expansion springs 104 when the latches 106 are squeezed together.

In the assembled unit of the second embodiment, the number of spacers 98 helps determine the height of the assembly and therefore the height of the pet door frame 30, but as will be seen below, the second embodiment provides a compressible piston like movement that allows the pet door panel 10 to be easily removed and re-inserted, once the height of the panel is adjusted.

As in the first embodiment, each spacer 98 nests in the spacer below. Each spacer 98 has a lower projecting wall 108 that nests within the upper wall 110 of the spacer 98 below. Each spacer 98 has a side wall 112, on both ends in this embodiment, with a slot 114 and a downwardly projecting tab 116 to engage the slot 114 of the spacer 98 below. The base housing 96 has a slot 118 to accommodate the tab 116 of a spacer 98 above it, and has an upper wall 120 to accommodate, in a nesting relationship, the lower projecting wall 108 of the spacer 98 above.

The topmost member 100 is in the form of a piston that is movable vertically within the upper spacer wall 110 of the spacer 98 below it. A pair of extender springs 122 are captured between the upper wall 124 of the topmost member 100 and a wall of the spacer 98 below to bias the topmost member 100 upwardly, away from the pacer 98. Downwardly projecting guides 124 interact with projections (not shown) in the spacer 98 below to make the piston action for the topmost member smooth.

The spacers 98 and the base housing 96 have vertical walls 126 to form passageways 128 for interlocking extender shaft portions 130 in the spacers 98, and for base extender shafts 132 that reside in the base housing 96. The base extender shafts 132 have diagonal bottom surfaces 134 that correspond to the diagonal serrated surfaces 136 of the wedges 102.

When the latches 106 are pulled together toward the center, they will pull the wedges 102 against the bias of the expansion springs 104, lowering the surface 136 of the wedges facing the base extender shaft 132. When the wedges 102 are released and in place, the wedge surfaces 136 abut the bottom surfaces 134 of the base extender shafts 132. The interlocking extender shaft portions 130 in spacers 98 above them prevent the topmost, or piston, member 100 from moving downwardly, since the topmost member 100 has a surface that engages the top of the extender shaft portion 130 in the spacer 98 below.

The general height of the pet door panel is selected by selecting the number of spacers 98. The tabs 116 that are interlocked with each slot 114 at both ends of each spacer can be disengaged with a small screwdriver by pushing the tabs 116 inwardly while pulling the spacers 98 apart.

When the appropriate number of spacers 98 are installed, including the topmost member 100, and the latches 106 are held together, the topmost member 100 is free to be compressed downwardly against springs 102. When the latches 106 are disengaged, the wedges 102 are free to move outwardly toward the ends, which make the base extender shaft 132 and the interlocked spacer extender shaft portions 130 rise to push against the topmost member, or piston, 100. Wherever the topmost member, or piston, 100 is positioned, the wedges 102 will prevent the member 100 from compressing further, thereby locking the pet door panel 10 in place in the sliding door frame 12. The pet door height adjustment panel in this embodiment is made narrower so that it can fit in one side of any door frame track with a center guide.

This embodiment is meant to be used as a portable model. The customer buys the pet door panel 10, with all the spacers 98 installed, and attempts to insert the top of the panel 10 (with the latches 106 held together) into the upper frame rail 18 of the sliding door frame 12, in effect compressing the topmost member 100 to allow the panel 10 to fit in the sill 20. If the pet door panel 10 is too tall, the customer removes the necessary number of spacers 98, and reattaches the top spacer 98 with the topmost, piston, member 100, and reinserts the panel 10 with the topmost member 100 compressed. The customer then releases the latches 106, thereby locking the panel into position. Conversely, to remove the pet door panel 10, the customer pulls the latches 106 together, allowing the topmost member 100 to compress and allow the panel 10 to be removed from the frame 12.

Other variations of the embodiments shown will be apparent to those skilled in the art, and are meant to be included in the scope of the following claims.

What is claimed is:

1. A height adjustable spacer apparatus and a pet door panel frame to be fitted within a sliding door frame, said apparatus comprising:

said pet door panel frame including a horizontal top frame member, at least one spacer having a downwardly projecting means for nesting engagement with said horizontal top frame member, and a sliding door frame engaging member, having a downwardly projecting means for nesting in a said spacer wherein said horizontal top frame member has a first perimeter in the horizontal plane, and said spacer and said sliding door frame engaging member have second and third perimeters, respectively, in the horizontal plane substantially aligned with said first perimeter, further including a nut secured to said horizontal top frame member, a screw seating portion in said sliding door engaging member, and a screw passable through said seating portion to engage said nut, said at least one spacer having an opening aligned with said nut and screw seating portion, whereby said screw secures said sliding door engaging member and said at least one spacer to said horizontal top frame member.

2. A height adjustable spacer apparatus and a pet door panel frame to be fitted within a sliding door frame, said apparatus comprising:

said pet door panel frame including a horizontal top frame member, at least one spacer having a downwardly projecting means for nesting engagement with said horizontal top frame member, and a sliding door frame engaging member, having a downwardly projecting means for nesting in a said spacer wherein said sliding door frame engaging member is movably biased away from said at least one spacer wherein said horizontal top frame member includes at least one wedge for movably engaging said at least one spacer to adjust the distance between said at least one spacer and said horizontal top frame member.

3. The apparatus of claim 2 wherein said horizontal top frame member includes biasing means for biasing said wedge means to engage said at least one spacer at a maximum distance of said at least one spacer from said horizontal top frame member.

* * * * *